US008262006B2

(12) United States Patent
Berger et al.

(10) Patent No.: US 8,262,006 B2
(45) Date of Patent: Sep. 11, 2012

(54) ROLL MILL

(75) Inventors: Markus Berger, Ennigerloh (DE); Pedro Guerrero Palma, Lippetal (DE)

(73) Assignee: Polysius AG, Beckum (DE)

( * ) Notice: Subject to any disclaimer, the term of this patent is extended or adjusted under 35 U.S.C. 154(b) by 295 days.

(21) Appl. No.: 12/669,514

(22) PCT Filed: May 27, 2008

(86) PCT No.: PCT/EP2008/056498

§ 371 (c)(1),
(2), (4) Date: Feb. 5, 2010

(87) PCT Pub. No.: WO2009/010329

PCT Pub. Date: Jan. 22, 2009

(65) Prior Publication Data

US 2010/0193616 A1 Aug. 5, 2010

(30) Foreign Application Priority Data

Jul. 17, 2007 (DE) ..... 10 2007 033 256

(51) Int. Cl.
*B02C 15/00* (2006.01)

(52) U.S. Cl. ..... 241/119

(58) Field of Classification Search ..... 241/117–121
See application file for complete search history.

(56) References Cited

U.S. PATENT DOCUMENTS

| | | | | |
|---|---|---|---|---|
| 1,967,236 | A * | 7/1934 | Fraser | 241/56 |
| 4,640,464 | A * | 2/1987 | Musto et al. | 241/34 |
| 4,715,544 | A | 12/1987 | Folsberg | |
| 4,796,817 | A * | 1/1989 | Zacher | 241/18 |
| 4,807,818 | A * | 2/1989 | Standring | 241/228 |
| 6,344,011 | B1 * | 2/2002 | Hosle | 475/343 |
| 6,401,561 | B1 * | 6/2002 | Hosle | 74/420 |

FOREIGN PATENT DOCUMENTS

| | | | |
|---|---|---|---|
| DE | 3240222 | A1 | 5/1983 |
| DE | 3633747 | A1 | 5/1987 |
| DE | 3545314 | A1 | 7/1987 |
| DE | 3640146 | A1 | 6/1988 |
| EP | 0561604 | A1 | 9/1993 |
| GB | 1305393 | A | 1/1973 |
| JP | 57047054 | A | 3/1982 |
| WO | WO-8101444 | A1 | 5/1981 |

* cited by examiner

*Primary Examiner* — Faye Francis
(74) *Attorney, Agent, or Firm* — Gifford, Krass, Sprinkle, Anderson & Citkowski, P.C.

(57) ABSTRACT

The invention relates to a roll mill having a grinding plate rotatable about an axis of rotation, at least one grinding roller in rolling engagement with the grinding plate, and a main drive for driving the grinding plate. An auxiliary drive for driving the grinding plate, and a regulating device are also provided, the regulating device including at least one damping regulator which regulates the auxiliary drive in dependence on torque variations of the main drive and/or variations in the speed of rotation of the grinding plate.

13 Claims, 2 Drawing Sheets

ROLL MILL

FIELD OF INVENTION

The invention relates to a roll mill having a grinding plate rotatable about an axis of rotation, at least one grinding roller in rolling engagement with the grinding plate, and a main drive for driving the grinding plate.

BACKGROUND OF THE INVENTION

At present, the grinding plates of vertical roll mills are driven by means of an unregulated asynchronous or synchronous motor and multistage gearing. With this arrangement, in practice very large torque variations arise, induced by the grinding process. Furthermore, an intensification of these torque variations may occur due to the oscillatory drive train (clutch, shafts, components with rigid teeth). A roll mill is known, for example, from DE 36 33 747 A1.

To be able to withstand these alternating high loads, all components directly and/or indirectly involved in the drive path must be designed specifically. In particular the alternating stresses due to characteristic vibrations within the drive train lead to a complex and therefore expensive designs. Moreover, in the case of larger mills, transmission damage has been known to occur which gives rise to severe operating losses on the part of the plant operator and can therefore generate a negative image for these mills.

In addition to the moment fluctuations, variations in the speed of rotation of the grinding plate also occur due to the irregular drive and the presence of elasticities. These are undesirable, as they can disturb the grinding process and in particular the grinding bed, and so negatively influence both throughput performance and energy consumption.

DE 36 40 146 A1 describes a planetary differential gear having a main and an auxiliary drive shaft for generating adjustable speeds of rotation. Via additional gear members, a couplable and decouplable power-transmitting connection may be made between the two drive shafts. DE 35 45 314 C2 discloses gearing for conveyor systems and for recovery or crushing plant, having at least one planetary spur gear stage as the driven stage and a gear wheel input stage connected to the driving motor. A torque-measuring device monitors the torque. If a settable maximum torque is exceeded, the driving motor is switched off.

The underlying aim of the invention is to propose a roll mill and a method of operating the roll mill wherein torque variations of the drive and/or variations in the rotation speed of the grinding plate are damped.

SUMMARY OF THE INVENTION

A roll mill according to the invention substantially comprises a grinding plate rotatable about an axis of rotation, at least one grinding roller in rolling engagement with the grinding plate, and a main drive for driving the grinding plate. An auxiliary drive for driving the grinding plate, and a thus are also provided, the regulating device including at least one damping regulator which regulates the auxiliary drive in dependence on torque variations of the main drive and/or variations in the speed of rotation of the grinding plate.

The auxiliary drive is used to produce part of the driving power required for driving the grinding plate. Dynamic peaks in the torque variations or rotation speed variations can also be reduced with the auxiliary drive.

Further configurations of the invention are the subject of the dependent claims.

According to a preferred embodiment, the main drive includes a planetary gear having a sun wheel, planet wheels and ring gear, the ring gear being rotatably arranged and the auxiliary drive being provided for driving the ring gear. With such a configuration of the main drive, the regulating device can regulate the auxiliary drive in dependence on torque variations of the sun wheel.

By means of suitable sensors, the torque of the main drive or of the sun wheel and/or the rotation speed of the grinding plate and can be detected and supplied to the regulating device as a measured variable.

According to a preferred configuration, the regulating device includes a state space controller.

BRIEF DESCRIPTION OF DRAWINGS

Further advantages and embodiments of the invention are described in greater detail below on the basis of the description and drawings.

The drawings are as follows.

DETAILED DESCRIPTION OF THE INVENTION

Figure 1:
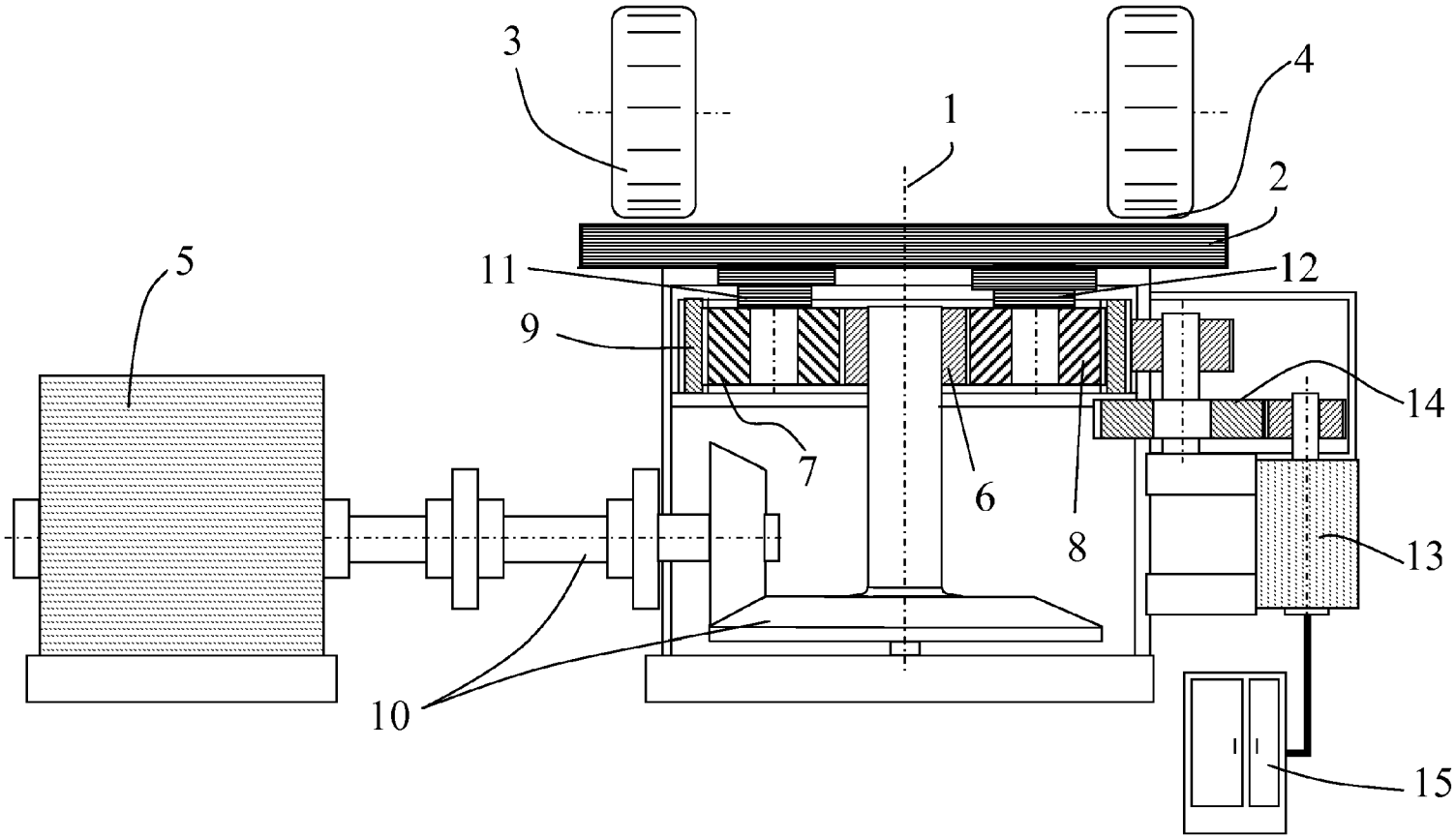
FIG. 1: a schematic representation of the roll mill.

The roll mill represented in FIG. 1 substantially comprises a grinding plate 2 rotatable about an axis of rotation 1, at least one grinding roller 3, 4 in rolling engagement with the grinding plate, and a main drive 5 for driving the grinding plate.

The main drive 5 includes a planetary gear having a sun wheel 6, a plurality of planet wheels 7, 8 and a ring gear 9. The main drive 5 drives the sun wheel 6 via a main drive train 10.

The planet wheels 7, 8 are linked to the grinding plate 2 via planet carriers 11, 12 in such a way that the grinding plate is able to rotate about the axis of rotation 1. In this arrangement the axis of rotation 1 is vertically orientated.

Furthermore, an auxiliary drive 13 is provided for driving the grinding plate 2. To this end the ring gear 9 of the planetary gear is rotatably arranged and coupled to the auxiliary drive 13 via an auxiliary drive train 14.

The auxiliary drive 13 is connected to a regulating device 15, wherein the regulating device regulates the auxiliary drive in dependence on torque variations of the main drive 5 and/or variations in the rotation speed of the grinding plate 2.

Figure 2:
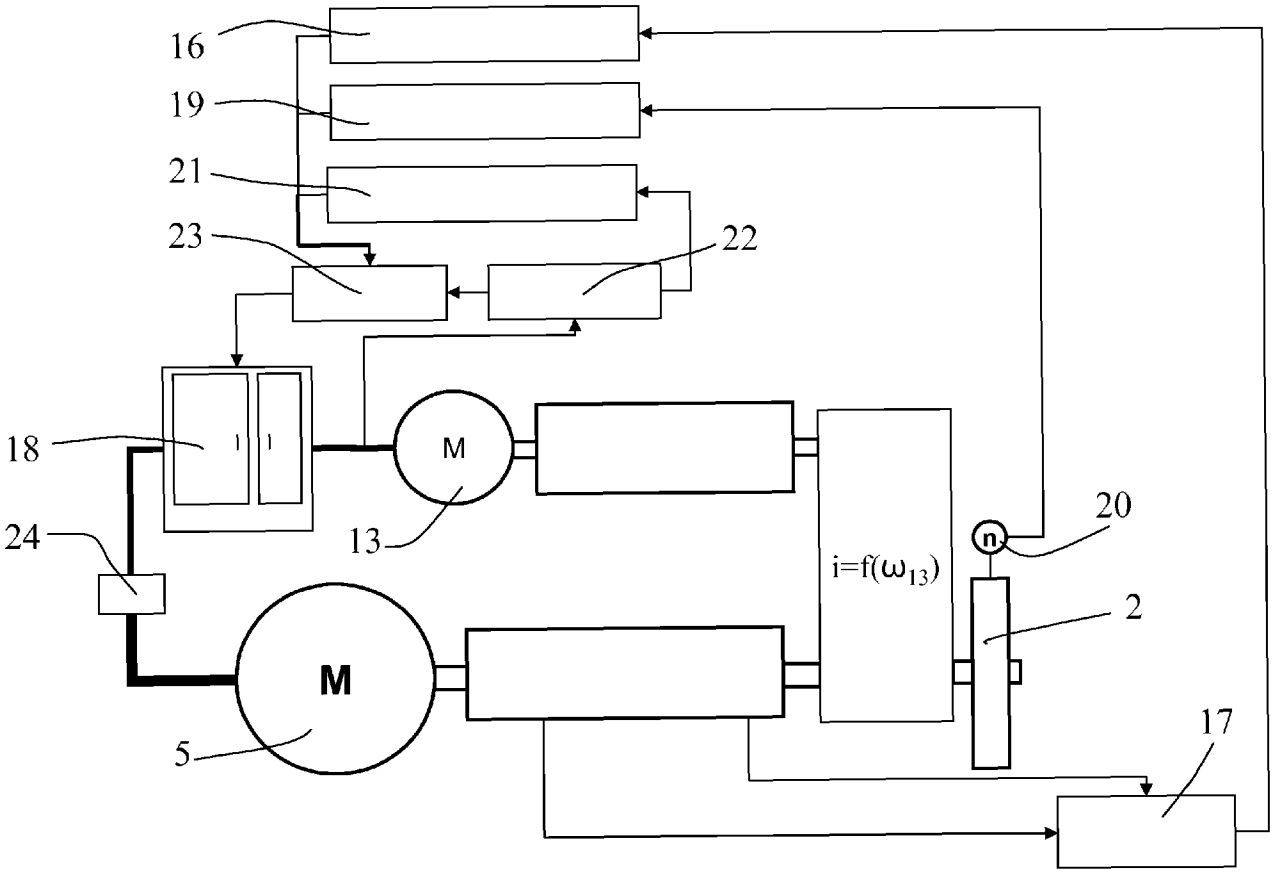
FIG. 2: a block diagram of the roll mill with regulating device.

The regulating device 15 represented in FIG. 2 by way of example includes at least one damping regulator, namely the main damping regulator 16, to which the actual torque of the sun wheel and a time-averaged torque of the sun wheel is supplied. The torque of the sun wheel is made available for example by means of a suitable sensor 17 or by means of a state model.

The main damping regulator 16 now calculates the reference speed of the auxiliary drive which, via its variable rotation speed, changes the transmission ratio of the gear and can thus counteract torque variations. The change in the speed of the auxiliary drive 13 is effected in particular via a frequency converter 18.

In order to avoid changes in the rotation speed of the grinding plate 2, a plate speed regulator 19 is provided, which receives the desired plate speed as the reference value and the actual plate speed as the actual value. The actual rotation speed of the grinding plate 2 is provided by either a sensor 20 or a state model. Furthermore, a damping regulator 21 may be provided for the auxiliary drive, for the purpose of balancing out torque variations by inciting the characteristic behaviour of the auxiliary drive.

According to requirements, differential weighting of the individual control circuits may be performed, by which means either the plate speed or the drive moment of the main drive 5 may be more strongly stabilised. It is also conceivable for the main damping regulator 16 and/or the plate speed regulator 19 to be designed as a state space controller, rather than conventionally as a PID regulator. In this arrangement, parameterisation occurs by predetermination of the poles within the image plane.

The auxiliary drive 13, which drives the ring gear 9 of the planetary gear, is driven via the frequency converter 18 with internal motor and mechanics model 22 and an active motor regulator 23. Advantageously, it should be equipped in such a way that the occasionally necessary braking energy can be fed back into the power supply 24, by which means the efficiency level of the whole system can be improved even further by comparison with the previously known systems.

In order to be able to dispense with expensive direct drives, the auxiliary drive is conventionally designed as a motor-gearing combination. Due to the variables predetermined by the main damping regulator 16 and the plate speed regulator 19 and the correction torques resulting therefrom, moment variations may occur even in the auxiliary drive train. These are damped by a sensorless state space controller.

Thus a system is available with which active damping of torques and/or variations in the rotation speed of the grinding plate can be achieved with great drive performances without the need to drive the main drive with the use of a frequency converter. On the auxiliary drive side also, separate drives can be dispensed with through the use of an active, sensorless state space controller.

As a result of this, for high power outputs (>2 MW), the costs of such a system are distinctly lower than if the main drive were to be actively influenced.

According to the invention, the torque measurement required for controlling the auxiliary drive 13 could also occur by high-dynamic angle of rotation measurement since, when damping is negligible, the twisting is proportional to the torque.

The drive output required for driving the grinding plate is advantageously provided by the auxiliary drive in a proportion of 5 to 30%, preferably 10 to 20%. In addition, on account of the high dynamics, a clear output reserve must be planned in for the frequency converter 18 (2 to 2.5 times the rated output of the control drive).

The invention claimed is:

1. A roll mill having:

a. a grinding plate (2) rotatable about an axis of rotation (1), b. at least one grinding roller (3, 4) in rolling engagement with the grinding plate, and c. a main drive (5) for driving the grinding plate, characterised in that at least one auxiliary drive (13) for driving the grinding plate (2), and a regulating device (15) are provided, wherein the regulating device includes at least one damping regulator (16, 21) which regulates the auxiliary drive in dependence on torque variations of the main drive (5) and/or variations in the speed of rotation of the grinding plate (2).

2. The roll mill according to claim 1, characterised in that the main drive (5) includes a planetary gear having sun wheel (6), planet wheels (7, 8) and ring gear (9), the ring gear being rotatably arranged and the auxiliary drive (13) being provided for driving the ring gear.

3. The roll mill according to claim 2, characterised in that the regulating device (15) regulates the auxiliary drive (13) in dependence on torque variations of the sun wheel (6).

4. The roll mill according to claim 1, characterised in that a frequency converter (18) is provided for regulating the auxiliary drive (13).

5. The roll mill according to claim 2, characterised in that the regulating device (15) includes a sensor (17) for detecting the torque of the sun wheel (6).

6. The roll mill according to claim 1, characterised in that the regulating device (15) includes a sensor (20) for detecting the rotation speed of the grinding plate (2).

7. The roll mill according to claim 1, characterised in that the regulating device (15) includes a state space controller.

8. A method of operating a roll mill comprising:

providing a roll mill having:

a. a grinding plate (2) rotatable about an axis of rotation (1), b. at least one grinding roller (3,4) in rolling engagement with the grinding plate, c. a main drive (5) for driving the grinding plate, d. at least one auxiliary drive (13) for driving the grinding plate (2), and e. a regulating device (15), wherein the regulating device regulates the auxiliary drive in dependence on torque variations of the main drive 5 and/or variations in the rotation speed of the grinding plate 2, in order to damp the torque variations of the main drive (5) and/or the rotation speed variations of the grinding plate (2).

9. The method according to claim 8, characterised in that, to control the auxiliary drive (13), account is taken of the actual and a time-averaged torque of the main drive (5).

10. The method according to claim 8, characterised in that, to control the auxiliary drive (13), account is taken of the deviation in the rotation speed of the grinding plate (2) relative to a reference speed.

11. The method according to claim 8, characterised in that the torque measurement necessary for controlling the auxiliary drive (13) is effected via a high-dynamic angle of rotation measurement.

12. The method according to claim 8, characterised in that any braking energy of the auxiliary drive (13) that may arise is used for energy purposes.

13. The method according to claim 8, characterised in that the drive output required for driving the grinding plate (2) is provided by the auxiliary drive (13) in a proportion of 5 to 30%, preferably 10 to 20%.

* * * * *